US005121435A

United States Patent [19]

Chen

[11] Patent Number: 5,121,435

[45] Date of Patent: Jun. 9, 1992

[54] ACOUSTIC CONTROL CIRCUIT FOR FREQUENCY CONTROL OF THE FLASHING OF CHRISTMAS LIGHT SETS

[76] Inventor: Ming-Hsiung Chen, 7F, 16 Alley 3, Lane 227, Nung-An St., Taipei, Taiwan

[21] Appl. No.: 433,713

[22] Filed: Nov. 13, 1989

Related U.S. Application Data

[63] Continuation-in-part of Ser. No. 284,994, Dec. 15, 1988.

[51] Int. Cl.[5] ..... H04R 29/00

[52] U.S. Cl. ..... 381/56; 381/110; 84/464 R

[58] Field of Search ..... 84/464 R; 381/110, 56

[56] References Cited

U.S. PATENT DOCUMENTS 4,056,805 11/1977 Brady ..... 84/464 R 4,256,009 3/1981 Verduin et al. ..... 84/464 R

OTHER PUBLICATIONS

Lancaster, TTL Cookbook, 1980, pp. 171-175.

National Semiconductor, AN72(15-17), Sep. 1972.

*Primary Examiner*—Forester W. Isen

*Attorney, Agent, or Firm*—Ladas & Parry

[57] ABSTRACT

An acoustic control circuit for sequencing the flashing of a Christmas light set according to the rhythm and volume of a sound, and more particularly a flash control circuit which makes use of externally produced acoustic intensity to effect the sequence of flashing in accordance with a predetermined sequence. A user can enjoy special flashing effect produced by the light set when such a light set is connected placed near and responsive to a sound generating unit like a stereo or other device.

3 Claims, 2 Drawing Sheets

ACOUSTIC CONTROL CIRCUIT FOR FREQUENCY CONTROL OF THE FLASHING OF CHRISTMAS LIGHT SETS

This is a Continuation-in-Part Application of copending U.S. application Ser. No. 284,994, filed Dec. 15, 1988.

BACKGROUND OF THE INVENTION

The present invention is to provide an acoustic control circuit for Christmas light sets and decorative lights and, more particularly, a control circuit to control the frequency of flashing Christmas light sets or decorative lights by means of acoustic intensity and according to a predetermined sequence.

Regular Christmas light set of the prior art are widely used during Christmas holidays. They provide only simple and monotonous flashing effects and are not very attractive. They cannot satisfy people's desire for innovation.

In view of said disadvantages, the innovative Christmas light set of the present invention is thus created to satisfy people's desires to celebrate, to promote fun and enjoyment, and to help produce a warm and joyful atmosphere on cold nights during the Holidays.

SUMMARY OF THE INVENTION

Christmas light sets are one of the necessities of every family for Christmas decoration. When talking about Christmas, imager of decorative Christmas lights, Christmas trees, Santa Claus, and Christmas music are conjured up. In Western Countries, in celebration of the Christmas holidays, families set up all kinds of Christmas light sets over Christmas trees, indoor or outdoor, before Christmas Eve.

In recent years, acoustic control technology has been widely used in application including daily usages to satisfy people's imagination for operation by acoustic control. Therefore, to apply acoustic control techniques in light sets may provide new visual effects and create a new fashion.

The present invention is applicable for use in rotary lamps, Christmas light sets, or other decorative lights which may be affected by the acoustic intensity of music or applause, to permit light sets or lamp series to flash sequentially. Further, when there is silence, any light set constructed according to the present invention may be arranged to let bulbs of some exclusive color, i.e. bulbs of the same lamp series, be constantly lit. By means of applause or any simple sound produced by any means, the light set will be affected to cause the bulbs of another exclusive color a capacitor C2 and a resistor R5 to the input of an to be constantly lit. By means of said arrangement, consumers can enjoy the fun of changing color lighting by a sound.

In general, the present invention is to provide an acoustic control circuit for Christmas light sets and decorative lights having numerous features each of which tends to make the structure more practical and utilitarian.

DESCRIPTION OF THE PREFERRED EMBODIMENT

The present invention is related to a Christmas light set of which the lamp bulbs are driven to flash one after another in proper sequence by means of the control of external sound source or internal signal source.

Figure 1:
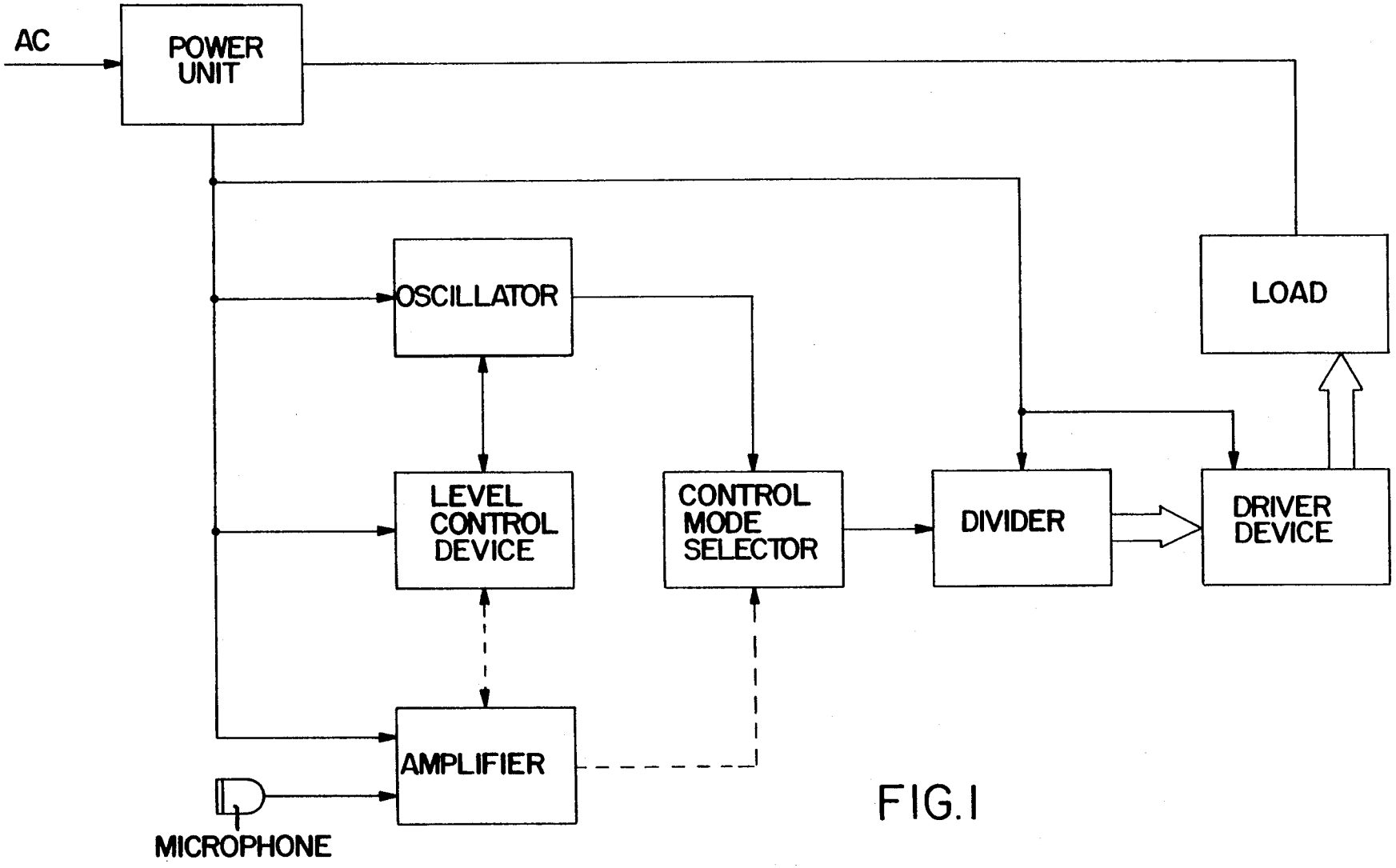
FIG. 1 is a block diagram of the present invention.
Figure 2:
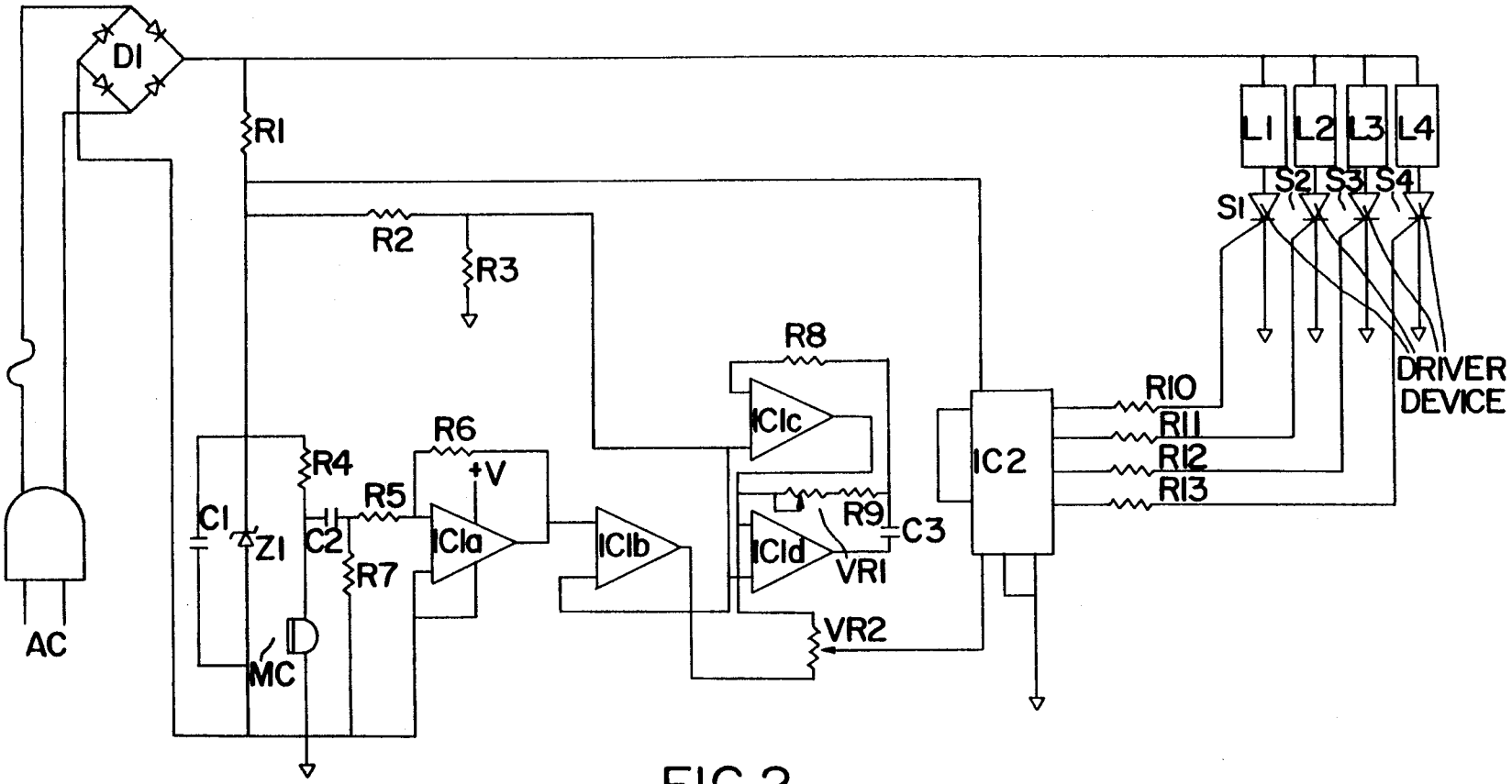
FIG. 2 is a circuit diagram of the present invention.

The external sound source control of the present invention is outlined hereinafter. As shown in FIGS. 1 and 2, outside music or sound is received by the Microphone MC and sent through a capacitor C2 nd a resistor R5 to the input of an Amplifier IC1a for amplification. The amplified sound signal is then processed by a comparator IC1b to provide a control signal proportional to the outside music or sound picked up by the Microphone MC. After passing through a Control Mode Selector, variable resistor VC2, the control signal thus obtained is sent to a Divider IC2 to further trigger the four loads L1–L4 of (representing four separate series of lamps) the Driver Devices S1-SV in proper sequence. By means of such operation, all of the lamp bulbs of each lamp series of a Christmas light set are controlled by an outside sound source to flash one after another in proper sequence.

The internal signal source control of the present invention is described hereinafter. As illustrated in FIGS. 1 and 2, an Oscillator a control signal output to the Divider IC2 via the Control Mode Selector VC2 to further trigger the Driver Device so as to turn on the lamps of a Christmas light set to flash one after another in proper sequence. As can be appreciated by reference to FIG. 2, the slider of variable resistor VR2 can be moved upwardly to select the output from IC1c which effects the sequencing of the lamps according to the frequency of the oscillator (IC1c, IC1d, and the position or variable resistor VR1. Alternatively, the slider of VR2 can be moved downwardly to select the output of IC1b which effects the sequencing o the lamps upon each occurrence of an externally produced acoustic disturbance sufficient to trigger Divider IC2 after amplification by Amplifier IC1a. In this manner, VR2 operates as a Control Mode Selector as previously indicated.

The integrated circuits used in this invention are identified as follows:

MANUFACTURER

ICI LM324C RCA TYPE OR EQUIVALENT

IC2 4017B NATIONAL SEMICONDUCTOR CORP TYPE OR EQUIVALENT

The difference between the external sound source control and the internal signal source control is that the frequency of the flashing of the lamp bulbs of a Christmas light set in the internal signal control mode is regulated through a variable resistor VR1 while in the external sound control mode the frequency of the flashing of the lamp bulbs of a Christmas light set is determined according to the intensity of external music or sound. Further, in the external sound control mode, when there is silence, the lamp bulbs of the Load of the same color are constantly turned on, and consumers may easily drive the lamp of a second color or third color or any other uniform color by means of clapping their hands or any other way to make a single sound which turns the lamps of each color on and off sequentially.

I claim:

1. An acoustic control circuit for acoustically sequencing the lighting of the lamps of a light set of the type which has series of lamps, each series of lamps being capable of lighting independently, said control circuit comprising:

means for producing a control signal responsive to the occurrence of and the intensity of an external sound source;

a plurality of device drivers, each device driver adapted to turn on and off one of said series of lamps; and a sequencer circuit having an input coupled to said means for producing a control signal, and a plurality of outputs, like in number to said plurality of device drivers, said sequencer circuit producing a lamp drive signal at said outputs one after another in sequence in response to the receipt of said control signal, each of said sequencer outputs being coupled to a corresponding device driver;

an internal signal source for producing a second control signal having a preset frequency;

a manually operated control mode selector receiving said first-mentioned control signal and said second control signal, and including means for selecting one of said control signals to be coupled to said sequencer input; whereby when said control mode selector is set to select said first-mentioned control signal, with no sound from said sound source, one of said sequencer outputs couples a lamp drive signal to one of said device drivers to light one of said series of lamps, and upon each occurrence of an external sound event, a control signal is produced by said means for producing a control signal and routed through said control mode selector to increment said sequencer and thereby produce a lamp drive signal on the next output in sequence, said last-mentioned lamp drive signal being coupled to its corresponding device driver to light its corresponding series of lamps.

2. The acoustic control circuit as claimed in claim 1, wherein each output of said sequencer produces a lamp drive signal continuously until another control signal is produced to increment said sequencer.

3. The acoustic control circuit as claimed in claim 1, wherein:

the lamps in each said series of lamps are all of the same color; and each said series of lamps has lamps of a color different from that of the other series.

* * * * *